US011655097B1

(12) United States Patent
Albert

(10) Patent No.: US 11,655,097 B1
(45) Date of Patent: May 23, 2023

(54) CONFIGURABLE PASTRY CONTAINER

(71) Applicant: Julia Michelle Albert, Castro Valley, CA (US)

(72) Inventor: Julia Michelle Albert, Castro Valley, CA (US)

( * ) Notice: Subject to any disclaimer, the term of this patent is extended or adjusted under 35 U.S.C. 154(b) by 28 days.

(21) Appl. No.: 16/949,964

(22) Filed: Nov. 23, 2020

Related U.S. Application Data

(60) Provisional application No. 62/939,526, filed on Nov. 22, 2019.

(51) Int. Cl.

| | |
|---|---|
| ***B65D 85/60*** | (2006.01) |
| ***B65D 5/32*** | (2006.01) |
| ***B65D 5/49*** | (2006.01) |
| ***B31B 50/26*** | (2017.01) |
| ***B65D 5/50*** | (2006.01) |
| ***B31B 50/00*** | (2017.01) |
| ***B65D 5/42*** | (2006.01) |

(52) U.S. Cl.
CPC ..... *B65D 85/60* (2013.01); *B31B 50/006* (2017.08); *B31B 50/26* (2017.08); *B65D 5/321* (2013.01); *B65D 5/4204* (2013.01); *B65D 5/48024* (2013.01); *B65D 5/503* (2013.01)

(58) Field of Classification Search
CPC .. B65D 5/503; B65D 5/48024; B65D 5/4204; B65D 5/321; B65D 85/60; B65D 85/36; B65D 5/5038; B65D 2585/363; B65D 5/5061; B65D 5/5213; B65D 71/72; B65D 2401/15; B65D 2401/20; B65D 25/54; B65D 2585/36; B65D 25/101; A21B 3/131; A47J 47/14
USPC ..... 229/120.07, 906, 904, 902; 206/562, 206/564, 589, 499, 216, 303; 220/507, 220/512
See application file for complete search history.

(56) References Cited

U.S. PATENT DOCUMENTS

| | | | | | |
|---|---|---|---|---|---|
| 1,499,369 | A | * | 7/1924 | Holland | B65D 5/5038 206/499 |
| 1,607,024 | A | * | 11/1926 | Thomson | B65D 5/48024 426/112 |
| D122,774 | S | | 10/1940 | Frederick | |
| 3,162,077 | A | | 12/1964 | Brummer | |
| 3,407,079 | A | | 10/1968 | Griffith | |
| 3,899,119 | A | * | 8/1975 | Roccaforte | B65D 5/5021 229/164 |
| 4,216,241 | A | | 8/1980 | Thompson | |
| D334,885 | S | | 4/1993 | Eastin | |
| 5,259,750 | A | | 11/1993 | Lewandowski | |
| D348,378 | S | * | 7/1994 | Crane | D7/610 |
| D349,615 | S | | 8/1994 | McLaughlin | |

(Continued)

FOREIGN PATENT DOCUMENTS

TR DM-075166 1/2011

*Primary Examiner* — Christopher R Demeree
(74) *Attorney, Agent, or Firm* — Adibi IP Group, PC; Amir V. Adibi; Andrew C. Palmer

(57) ABSTRACT

A configurable pastry container is disclosed. In an embodiment, a configurable container is provided that includes a container bottom and a configurable rack that is placed within the container bottom. The configurable rack comprises one or more configurable openings that are configured to secure pastries having a plurality of sizes. The container also includes a container top that covers the container bottom to form an enclosed container that secures the pastries.

15 Claims, 14 Drawing Sheets

CONFIGURABLE DOZEN PASTRY CONTAINER
EXPLODED VIEW

(56) References Cited

U.S. PATENT DOCUMENTS

| | | | | | |
|---|---|---|---|---|---|
| D365,502 | S | * | 12/1995 | Runge | D7/610 |
| 5,975,412 | A | * | 11/1999 | Guillin | B65D 5/325 220/DIG. 25 |
| 6,296,120 | B1 | * | 10/2001 | Danko | B65D 5/503 229/906 |
| 6,527,123 | B1 | * | 3/2003 | Ausaf | B65D 81/113 206/541 |
| D487,673 | S | | 3/2004 | Mishan | |
| 6,758,008 | B1 | | 7/2004 | Thebolt | |
| 6,973,872 | B2 | | 12/2005 | Morgan | |
| 7,303,115 | B1 | * | 12/2007 | McClymont | B65D 5/6664 229/152 |
| 7,517,933 | B2 | | 4/2009 | Holmes | |
| D729,589 | S | | 5/2015 | Logan | |
| D734,075 | S | | 7/2015 | Tapper | |
| D789,788 | S | | 6/2017 | Rossiter | |
| D793,252 | S | | 8/2017 | Prince | |
| D803,701 | S | | 11/2017 | Sellari | |
| D843,224 | S | | 3/2019 | Alatriste | |
| 10,575,678 | B1 | | 3/2020 | Anderson | |
| D921,483 | S | | 6/2021 | Albert | |
| 2005/0238773 | A1 | | 10/2005 | Stease | |
| 2015/0034664 | A1 | | 2/2015 | Baecher | |
| 2015/0344216 | A1 | * | 12/2015 | Petty | B65D 5/6626 206/589 |
| 2020/0122910 | A1 | | 4/2020 | Cruz | |

* cited by examiner

CONFIGURABLE PASTRY CONTAINER

CONFIGURABLE DOZEN PASTRY CONTAINER
EXPLODED VIEW

CONTAINER TOP VIEW

CONTAINER BOTTOM VIEW

CONTAINER SIDE VIEW

CONTAINER END VIEW

CONTAINER BOTTOM

CONTAINER BOTTOM

UNFOLDED FORM FOR CONTAINER BOTTOM

UNFOLDED FORM FOR TRAY

UNFOLDED FORM FOR RACK

FORM FOR RACK PERSPECTIVE VIEW

RACK (SIDE AND END) EDGE VIEWS

RACK OPENING

UNFOLDED FORM FOR CONTAINER TOP

METHOD FOR FORMING A CONFIGURABLE CONTAINER

CONFIGURABLE HALF DOZEN PASTRY CONTAINER

CONFIGURABLE HALF DOZEN PASTRY CONTAINER
EXPLODED VIEW

TOP VIEW

BOTTOM VIEW

SIDE VIEW

END VIEW

BOTTOM WITH SAME-SIZE PASTRIES

BOTTOM WITH DIFFERENT-SIZE PASTRIES

UNFOLDED TOP

UNFOLDED BOTTOM

CONFIGURABLE RACK

CONFIGURABLE RACK

RACK SIDE EDGE VIEW

RACK END EDGE VIEW

BOTTOM WITH SAME-SIZE PASTRIES

CONFIGURABLE PASTRY CONTAINER

CROSS-REFERENCE TO RELATED APPLICATIONS

This application claims the benefit under 35 U.S.C. § 119 of U.S. Provisional Application No. 62/939,526 filed on Nov. 22, 2019 and entitled "Configurable Pastry Container," the disclosure of which is incorporated by reference herein in its entirety.

TECHNICAL FIELD

The present invention relates generally to containers, and more specifically, to a configurable pastry container.

BACKGROUND INFORMATION

With the advent of online shopping, consumers are receiving an increasing number of package deliveries at their homes and offices. In particular, an increasing number of food items are being ordered for delivery. For example, pastries such as muffins and cupcakes are routinely packaged for delivery. Generally, pastries are loosely placed inside a cardboard container for storage or delivery. This method is used since the pastries may have different sizes such that it is easier to loosely place them in a generic container.

SUMMARY

In various embodiments, a configurable pastry container is provided that accepts and secures pastries for delivery. In one embodiment, the container includes a rack with configurable openings that are used to secure the pastries. For example, the rack may have twelve openings to secure a dozen muffins. The openings are configurable to various sizes so that different sized muffins can be secured within the openings. The openings include one or more tabs that are foldable or removable so that a diameter of each opening is configurable. In one example, the tab is single round, donut-shaped material that is punched out and removed. In another example, the tab is a plurality of opening tabs (or sections) that can be folded or removed to configure the size of the opening. Thus, one adjustable container can be configured to secure pastries of different sizes.

In one embodiment, a configurable container is provided that includes a container bottom and a configurable rack that is placed within the container bottom. The configurable rack comprises one or more configurable openings that are configured to secure pastries having a plurality of sizes. The container also includes a container top that covers the container bottom to form an enclosed container that secures the pastries.

In another embodiment, a method is provided for forming a configurable container. The method includes forming a container bottom, forming a configurable rack having configurable openings that are sized to secure a plurality of pastries, forming a container top, placing the configurable rack within the container bottom, and placing the container top over the container bottom.

In accordance with at least one novel aspect, the configurable pastry container is designed to provide quick and efficient assembly. A pastry provider is able to employ lower cost staff to prepare and assemble the novel configurable pastry container more quickly than conventional pastry containers. A package of novel configurable pastry containers is provided to a pastry provider in an unassembled fashion. Each of the configurable pastry containers has a container bottom, a configurable rack, and a container top that are provided in a flattened, unassembled state. In this way, the package of configurable pastry containers consumes minimal volume and is easy to store. Once the pastry provider desires use of the configurable pastry containers, they remove and assemble each component in a quick and convenient fashion.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

In various embodiments, a configurable pastry container is provided that can be configured to accept and secure different sized food items or pastries for storage and/or transportation.

Figure 1:
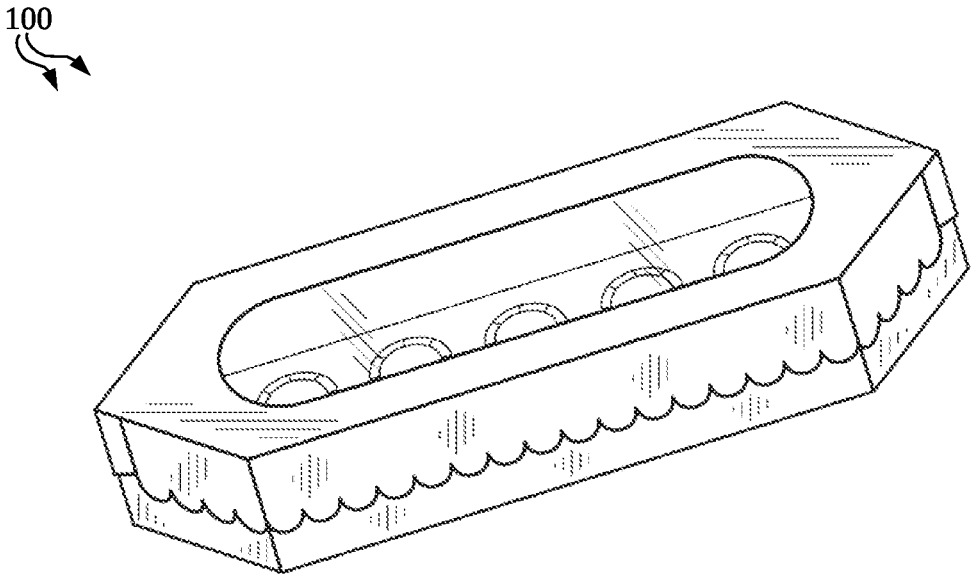
FIG. 1 shows a perspective view of an exemplary embodiment of a configurable pastry container.

FIG. 1 shows a perspective view of an exemplary embodiment of a configurable pastry container 100. The container 100 and its components are formed from at least one of paper, cardboard, plastic, and/or other suitable material. As described in more detail below, the container 100 can be configured to secure food items, such as pastries, having different sizes. For example, in one configuration, the container 100 can be configured to secure a dozen muffins. A more detailed description of the configurable pastry container 100 is provided below.

Figure 2:
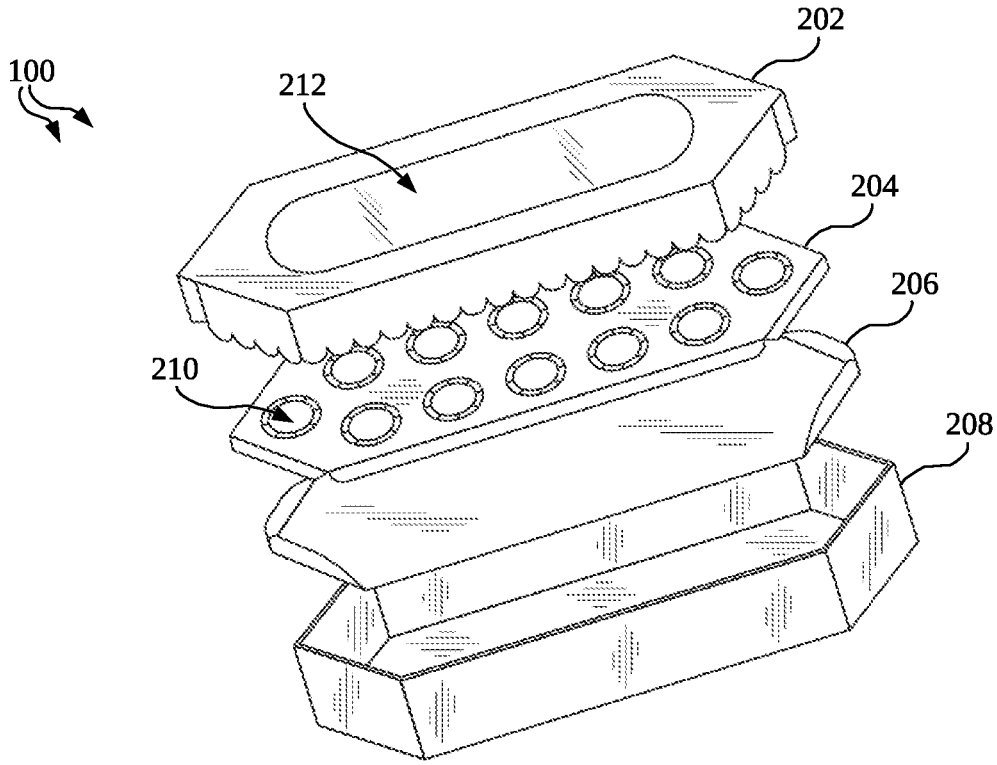
FIG. 2 shows an exploded view of the configurable pastry container shown in FIG. 1.

FIG. 2 shows an exploded view of the configurable pastry container 100 shown in FIG. 1. As illustrated in FIG. 2, the configurable pastry container 100 comprises a top cover 202, pastry rack 204, internal tray 206, and bottom portion 208. In an embodiment, the top cover 202 comprises a transparent window 212 that provides a view of the pastries secured within the container 100. In an embodiment, the window 212 is made of clear plastic, film, or other suitable material.

The pastry rack 204 comprises one or more configurable openings 210 that can be configured to have different sizes to accommodate pastries of different sizes.

Figure 3:
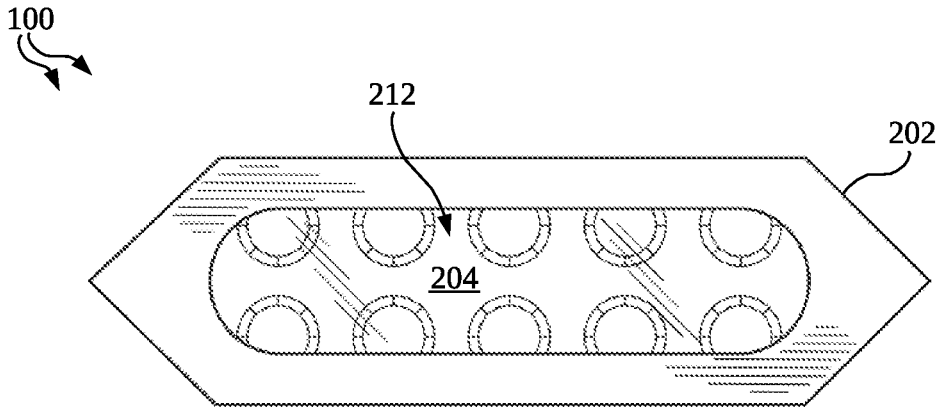
FIG. 3 shows a top view of the configurable pastry container shown in FIG. 1.

FIG. 3 shows a top view of the configurable pastry container 100 shown in FIG. 1. The top view illustrated in FIG. 3 shows the top cover 202 and transparent window 212. The pastry rack 204 is viewable visible through the transparent window 212.

Figure 4:
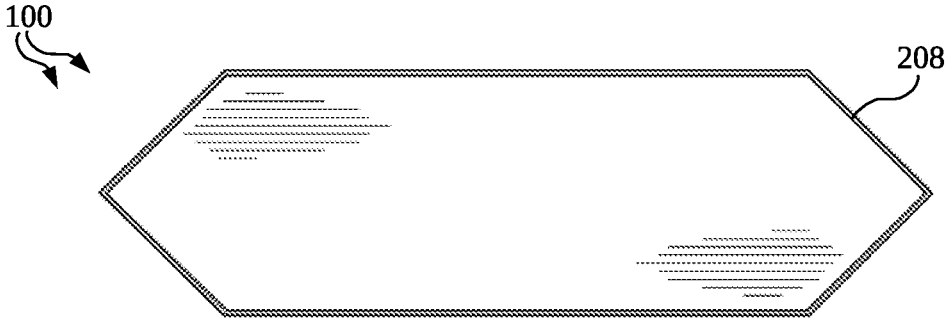
FIG. 4 shows a bottom view of the configurable pastry container shown in FIG. 1.

FIG. 4 shows a bottom view of the configurable pastry container shown in FIG. 1. As illustrated in FIG. 4, the bottom view shows the bottom surface of the bottom portion 208.

Figure 5:
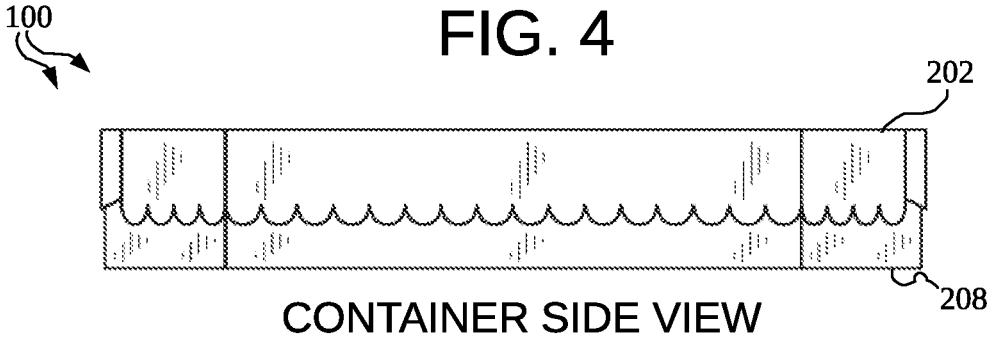
FIG. 5 shows a side view of the configurable pastry container shown in FIG. 1.

FIG. 5 shows a side view of the configurable pastry container 100 shown in FIG. 1. As illustrated in FIG. 5, the side view shows the top cover 202, which overlaps and partially covers the bottom portion 208.

Figure 6:
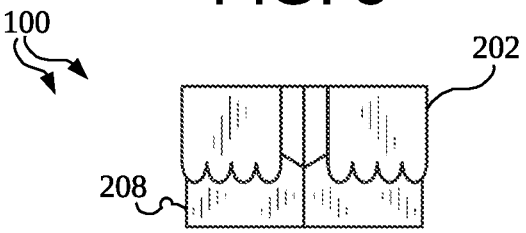
FIG. 6 shows an end view of the configurable pastry container shown in FIG. 1.

FIG. 6 shows an end view of the configurable pastry container 100 shown in FIG. 1. As illustrated in FIG. 6, the end view shows the top cover 202, which overlaps and partially covers the bottom portion 208.

Figure 7A:
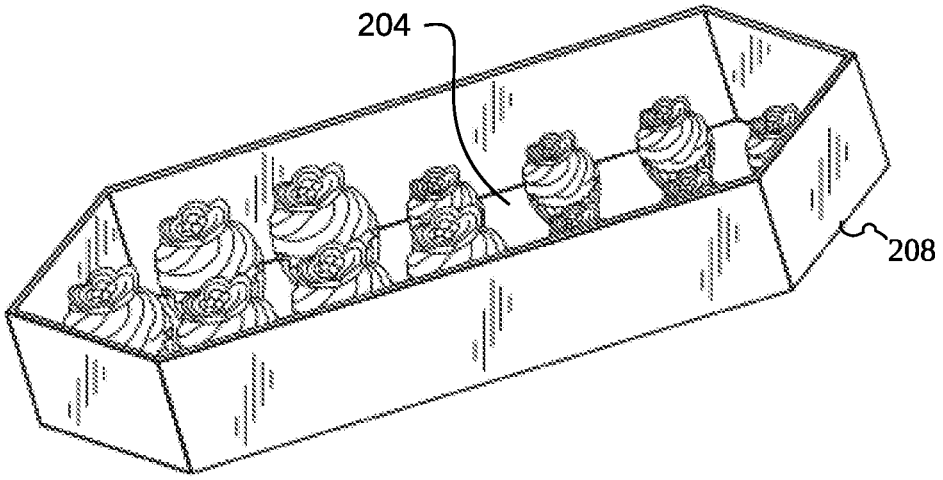
FIGS. 7A-B shows perspective views of a bottom portion of the configurable pastry container shown in FIG. 1.

FIG. 7A shows a perspective view of the bottom portion 208 of the configurable pastry container 100 shown in FIG. 1. The rack 204 is placed within the bottom portion 208 after being configured to retain different sized pastries. In this embodiment, six of the tabs of the rack 204 are removed to accommodate and secure larger sized pastries. It is appreciated that different combinations of opening sizes of the rack 204 are user configurable depending on the number and type of pastries. In one example, all the tabs of the rack 204 are removed to secure a dozen large pastries. In another example, no tabs of the rack 204 are removed to secure a dozen smaller pastries. In another example, the openings of the rack 204 are selectively configured to alternate between small openings and large openings thereby providing a visual appealing effect of alternating sized pastries.

Figure 7B:
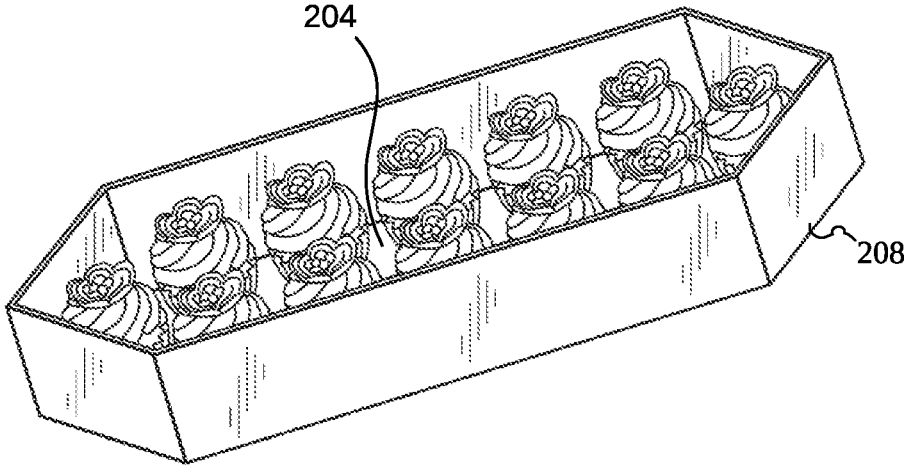

FIG. 7B shows a perspective view of the bottom portion 208 of the configurable pastry container 100 shown in FIG. 1. In this embodiment, the rack 204 is placed within the bottom portion 208 and is configured to secure a plurality of same-sized pastries as shown.

Figure 8:
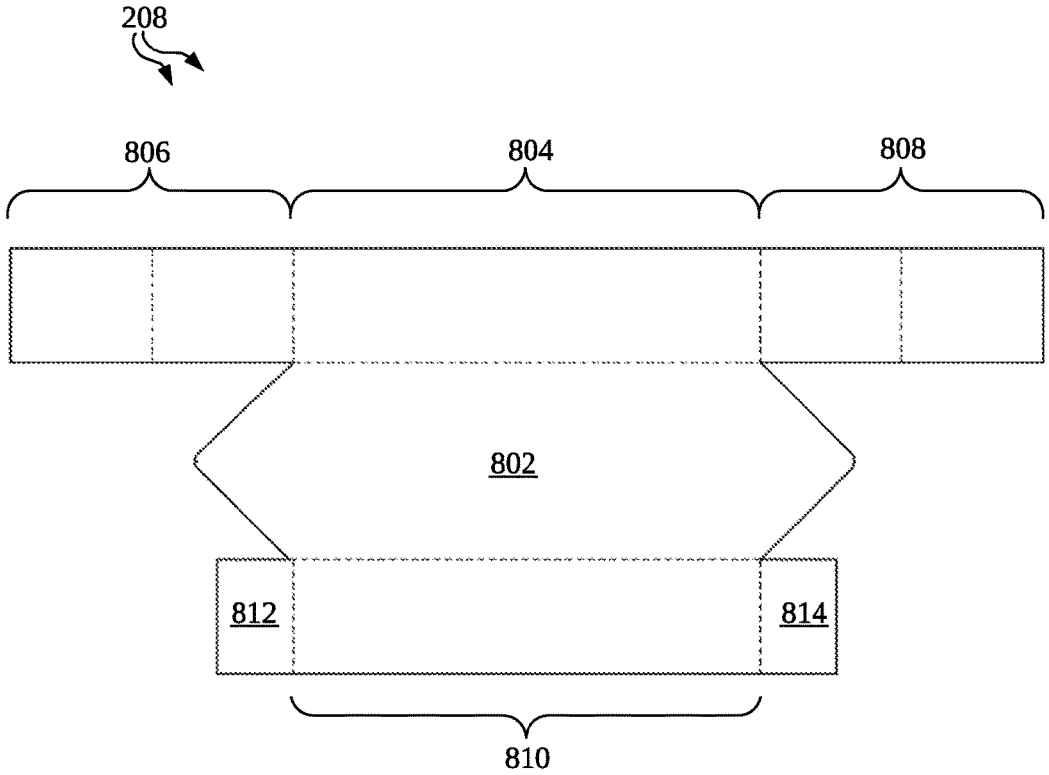
FIG. 8 shows an exemplary unfolded form of the bottom portion shown in FIG. 7.

FIG. 8 shows an exemplary unfolded form of the bottom portion 208 of the configurable pastry container shown in FIG. 2. The unfolded form includes bottom section 802, side section 804, end section 806, end section 808, and side section 810. The various sections fold up and bend according to the illustrated fold lines (dotted) to form the bottom portion 208. In an embodiment, the tabs 812 and 814 are secured to the folded end sections 806, 808 to hold the folded sections of the bottom portion 208 together as a complete unit.

Figure 9:
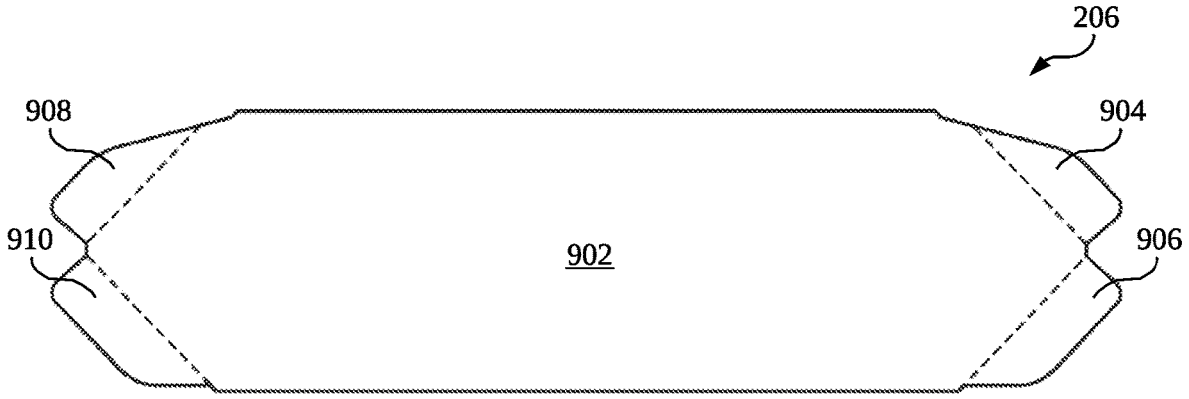
FIG. 9 shows an exemplary unfolded form of the inside tray portion shown in FIG. 2.

FIG. 9 shows an exemplary unfolded form of the tray portion 206 shown in FIG. 2. In an embodiment, the unfolded tray portion 206 comprises a bottom tray section 902 and tray tabs 904, 906, 908, and 910. The tray tabs 904, 906, 908, and 910 are folded along the dotted lines to form the tray portion 206. In an embodiment, the tray portion 206 fits into and rests onto the bottom portion 208.

Figure 10:
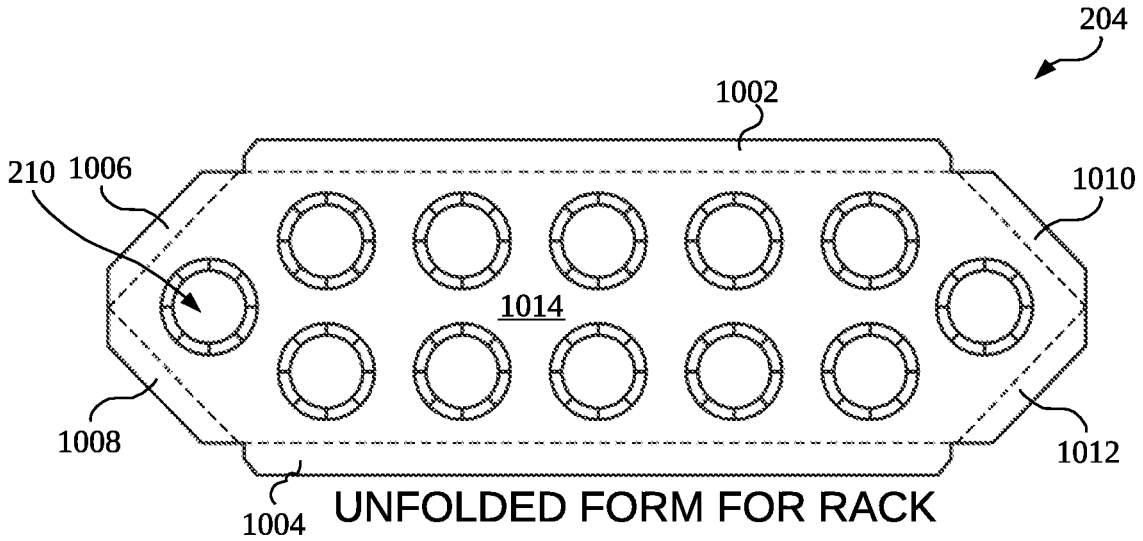
FIG. 10 shows an exemplary unfolded form of the adjustable rack shown in FIG. 2.

FIG. 10 shows an exemplary unfolded form of the configurable rack 204 shown in FIG. 2. In an embodiment, the rack 204 comprises a bottom rack section 1014 and rack tabs 1002, 1004, 1006, 1008, 1010, and 1012. The rack tabs 1002, 1004, 1006, 1008, 1010, and 1012 are folded along the dotted lines to form the rack 204. The rack 204 also includes configurable openings, such as opening 210. A more detailed description of the configurable openings is provided below. In an embodiment, the rack portion 204 fits into and rests onto the tray portion 206.

Figure 11:
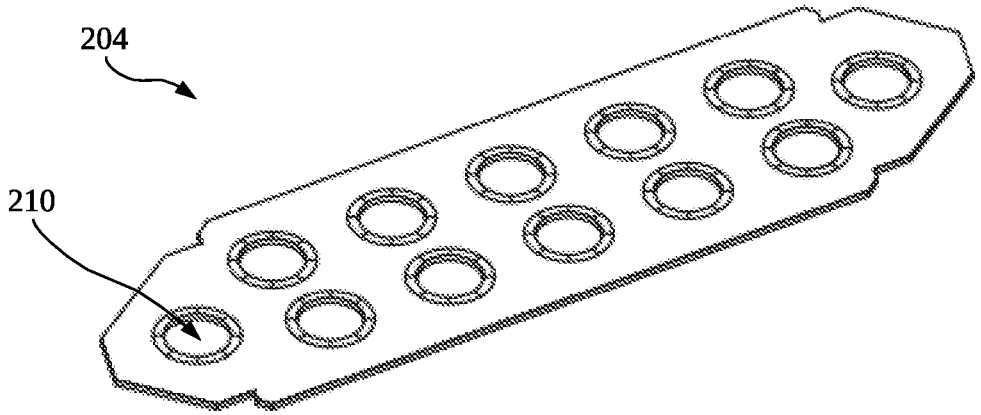
FIG. 11 shows an exemplary perspective view of the adjustable rack shown in FIG. 10.

FIG. 11 shows an exemplary perspective view of the unfolded form of the configurable rack 204 shown in FIG. 10.

Figure 12:
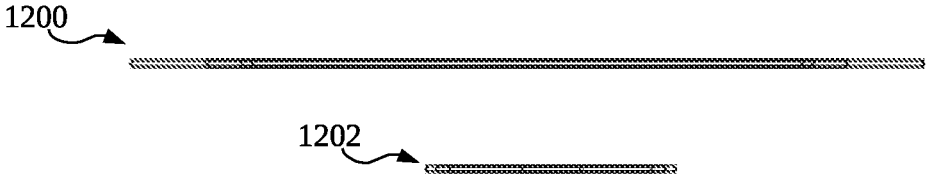
FIG. 12 shows exemplary side and end edge views of the adjustable rack shown in FIG. 10.

FIG. 12 shows an exemplary side 1200 and end 1202 edge views of the unfolded form of the configurable rack 204 shown in FIG. 10.

Figure 13:
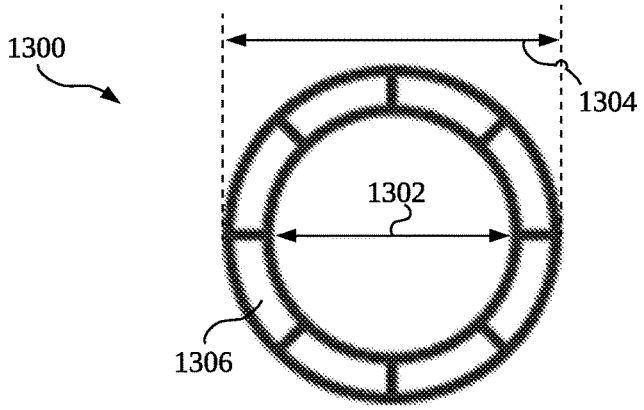
FIG. 13 shows an exemplary embodiment of a configurable opening.

FIG. 13 shows an exemplary embodiment of a configurable opening 1300. For example, the opening 1300 is suitable for use as any of the openings in the configurable rack 204, such as the opening 210. A plurality of opening tabs, such as tab 1306, form the size of the opening 1300. The opening 1300 can be configured to have a minimum sized opening having a diameter 1302 by leaving the opening tabs (e.g., 1306) unfolded. The opening 1300 can also be configured to have a maximum sized opening having a diameter 1304 by folding or removing the opening tabs (e.g., 1306). The opening tabs are removable or foldable so that the diameter of the opening is configurable by the user. Each of the opening tabs can be independently folded or removed to create up to the maximum opening having a diameter 1304. By adjusting or removing the tabs, the opening 1300 can be configured to secure pastries of different sizes. In one example, the tab is a single round, donut-shaped material that is punched out and removed. In another example, the tab is a plurality of sections that are folded or removed to obtain the desired opening diameter.

Figure 14:
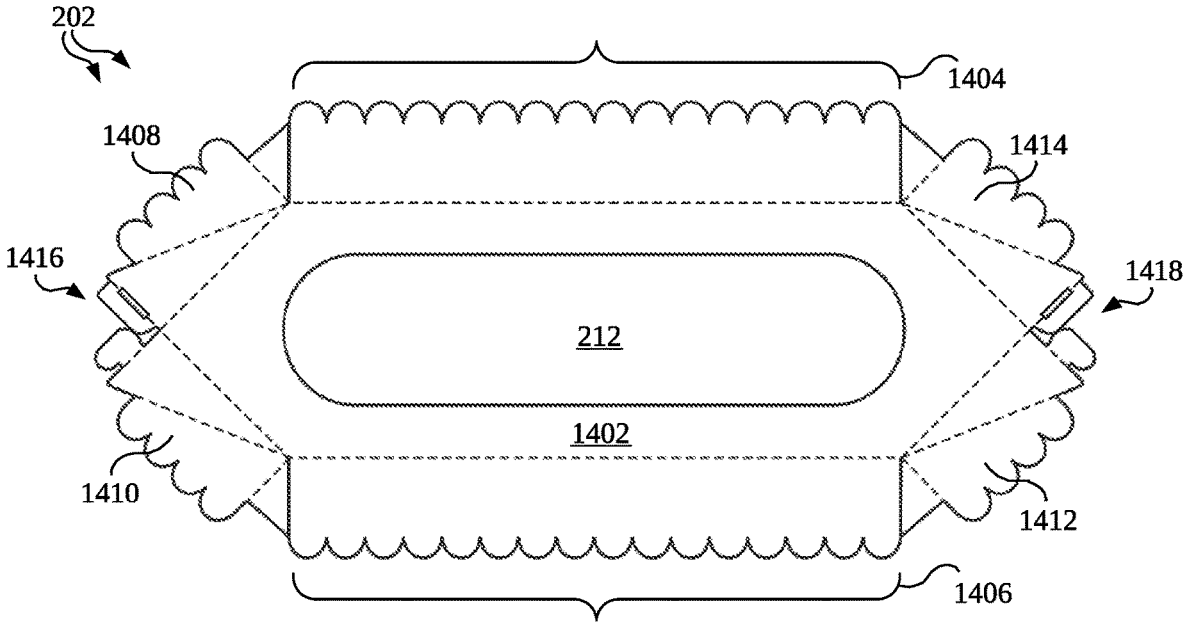
FIG. 14 shows an exemplary unfolded form of the top portion shown in FIG. 2.

FIG. 14 shows an exemplary unfolded form of the top portion 202 shown in FIG. 2. The unfolded form includes top section 1402, top side sections 1404 and 1406, top end sections 1408, 1410, 1412, and 1414. The various side and end sections fold and bend according to the illustrated fold lines (dotted lines) to form the top portion 202. Also shown in FIG. 14 is the transparent window 212. In an embodiment, the tabs 1416 and 1418 are used to secure the folded sections to hold the top portion 202 together as a complete unit.

Figure 15:
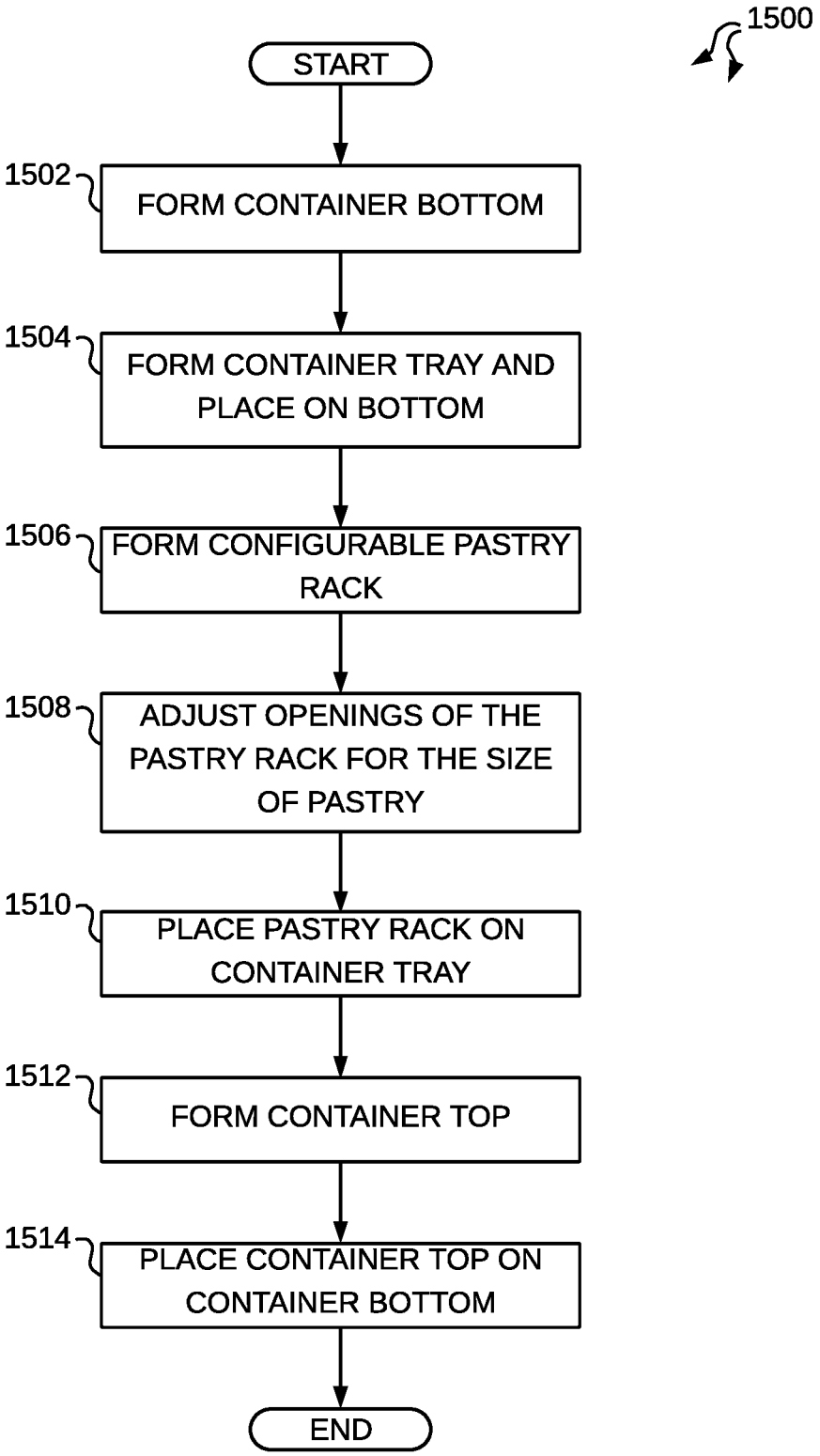
FIG. 15 shows an exemplary embodiment of a method for forming a configurable pastry container.

FIG. 15 shows an exemplary embodiment of a method 1500 for forming a configurable pastry container. For example, the method 1500 is suitable to form the configurable pastry container and its components shown in FIGS. 1-14.

At block 1502, a container bottom is formed. For example, the container bottom 208 is formed by folding and securing the container bottom form shown in FIG. 8.

At block 1504, a container tray is formed and placed within the container bottom. For example, the container tray 206 is formed by folding tabs 904, 906, 908, and 910 along the fold lines as illustrated in FIG. 9.

At block 1506, a configurable pastry rack is formed. For example, the rack 204 is formed by folding tabs 1002, 1004, 1006, 1008, 1010, and 1012 along the fold lines as illustrated in FIG. 10.

At block 1508, the openings of the pastry rack are adjusted for the size of the pastry to be secured. For example, the tabs (e.g., 1306) of the opening 1300 are folded to configure the opening to have the desired opening diameter 1302.

At block 1510, the configured pastry rack is placed on the container tray. For example, the configured rack 204 is placed on the tray 206 and inserted into the bottom 208.

At block 1512, a container top is formed. For example, the top 202 is formed by folding tabs 1404, 1406, 1408, 1410, 1412, and 1414 along the fold lines and securing the tabs 1416 and 1418 as illustrated in FIG. 14.

At block 1514, the container top is placed over the container bottom to complete the formation of the configurable pastry container. For example, the top 202 is placed over the bottom 208 as illustrated in FIG. 2.

Thus, the method 1500 performs operations to form a configurable pastry container. It should be noted that the method 1500 is exemplary and that the operations can be changed, modified, added to, deleted, or otherwise rearranged within the scope of the embodiments.

Figure 16:
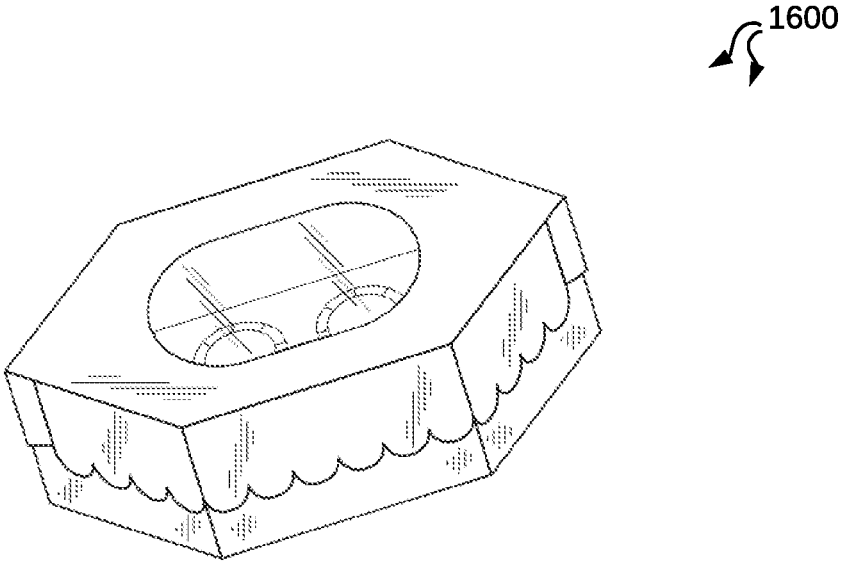
FIG. 16 shows a perspective view of an exemplary embodiment of a configurable pastry container that is configured to contain a half dozen pastries.

FIG. 16 shows a perspective view of an exemplary embodiment of a configurable pastry container 1600 that is configured to contain a half dozen pastries. In an embodiment, the container 1600 is configured to hold the same or different sized pastries.

Figure 17:
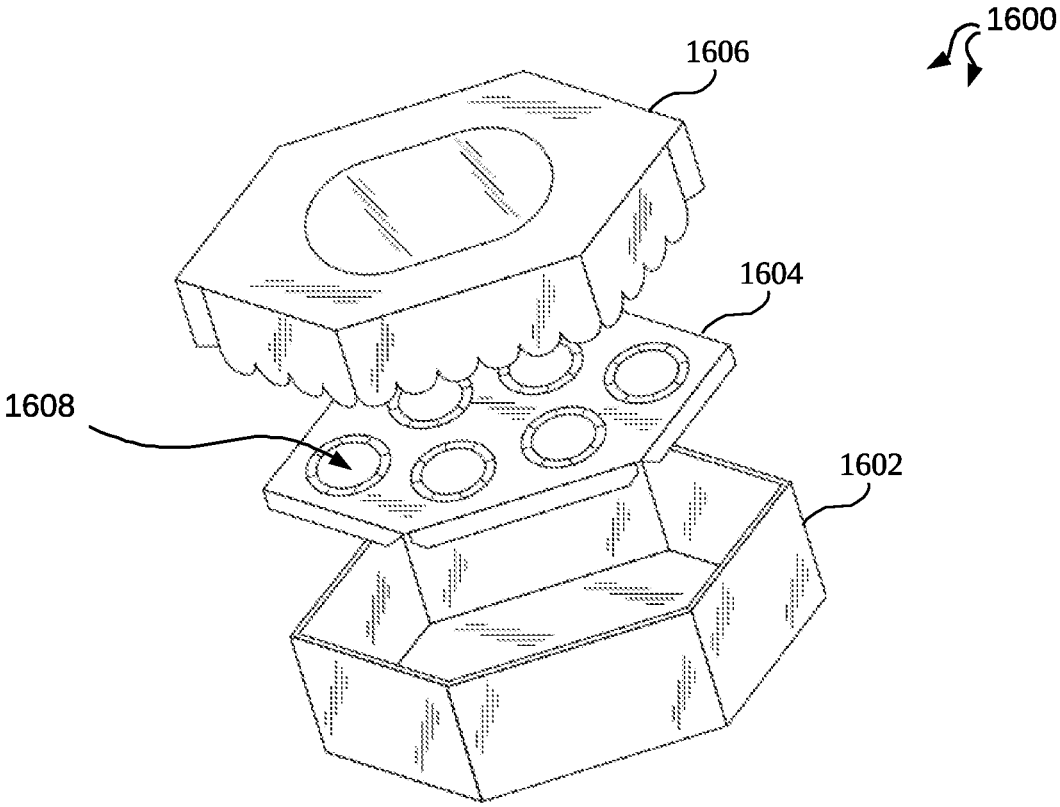
FIG. 17 shows an exploded view of the configurable pastry container shown in FIG. 16.

FIG. 17 shows an exploded view of the configurable pastry container 1600 shown in FIG. 16. The pastries container 1600 comprises a bottom 1602, an adjustable rack 1604, and a top 1606. For example, the adjustable rack 1604 includes six configurable openings, such as opening 1608.

Figure 18:
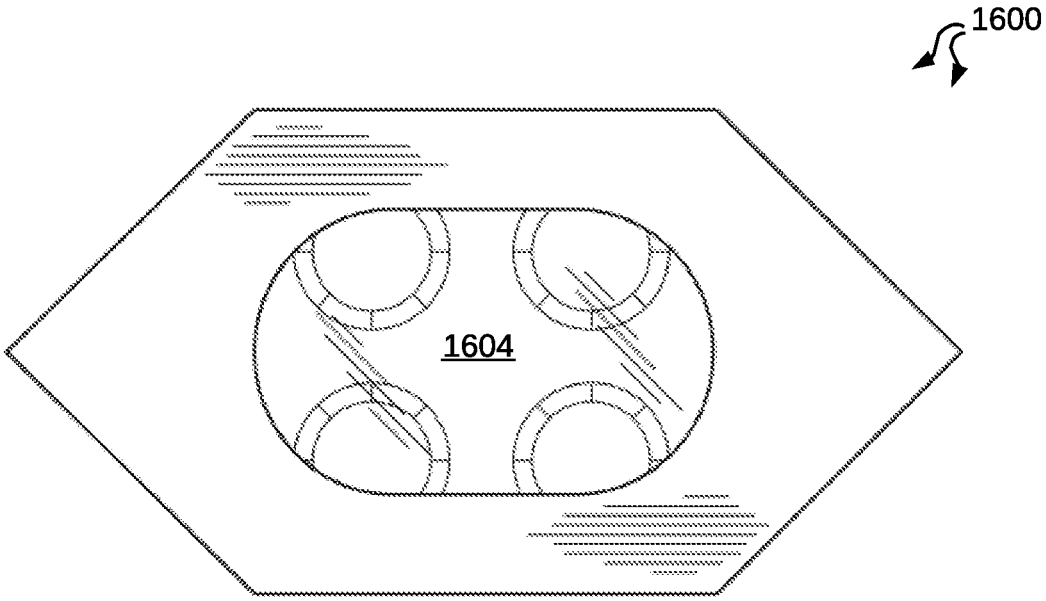
FIG. 18 shows a top view of the configurable pastry container shown in FIG. 16.

FIG. 18 shows a top view of the configurable pastry 1600 container shown in FIG. 16. The rack 1604 is visible through a clear window of the top portion 1606.

Figure 19:
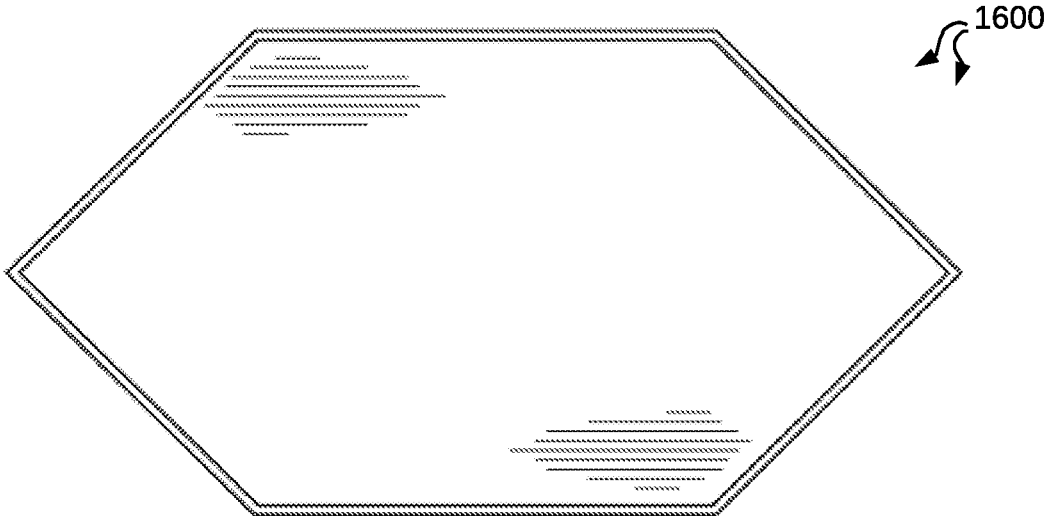
FIG. 19 shows a bottom view of the configurable pastry container shown in FIG. 16.

FIG. 19 shows a bottom view of the configurable pastry container 1600 shown in FIG. 16.

Figure 20:
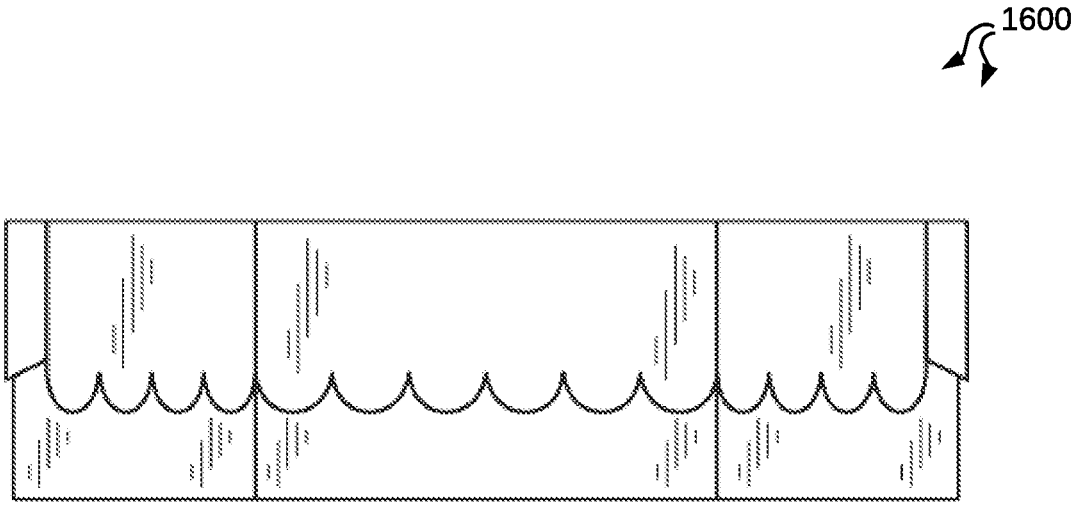
FIG. 20 shows a side view of the configurable pastry container shown in FIG. 16.

FIG. 20 shows a side view of the configurable pastry container 1600 shown in FIG. 16.

Figure 21:
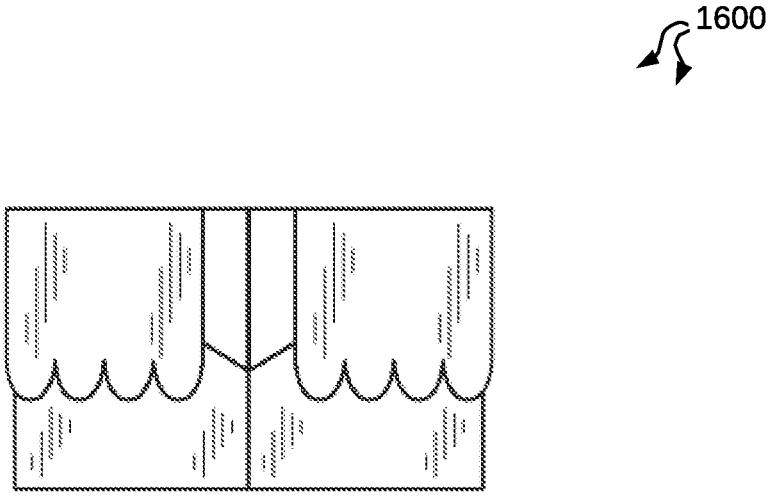
FIG. 21 shows an end view of the configurable pastry container shown in FIG. 16.

FIG. 21 shows an end view of the configurable pastry container 1600 shown in FIG. 16.

Figure 22:
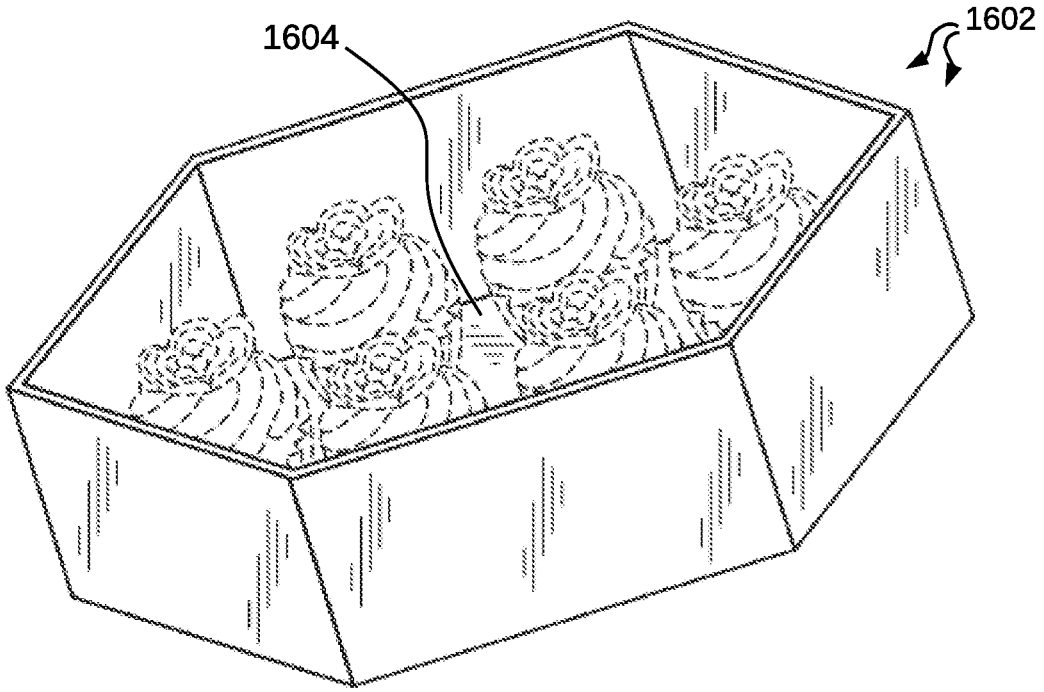
FIG. 22 shows a perspective view of a bottom of the configurable pastry container shown in FIG. 16 that is configured to hold six same-size pastries.

FIG. 22 shows a perspective view of the bottom 1602 of the configurable pastry container 1600 shown in FIG. 16. As illustrated in FIG. 22, the configurable openings of the rack 1604 are configured to hold six same-size pastries.

Figure 23:
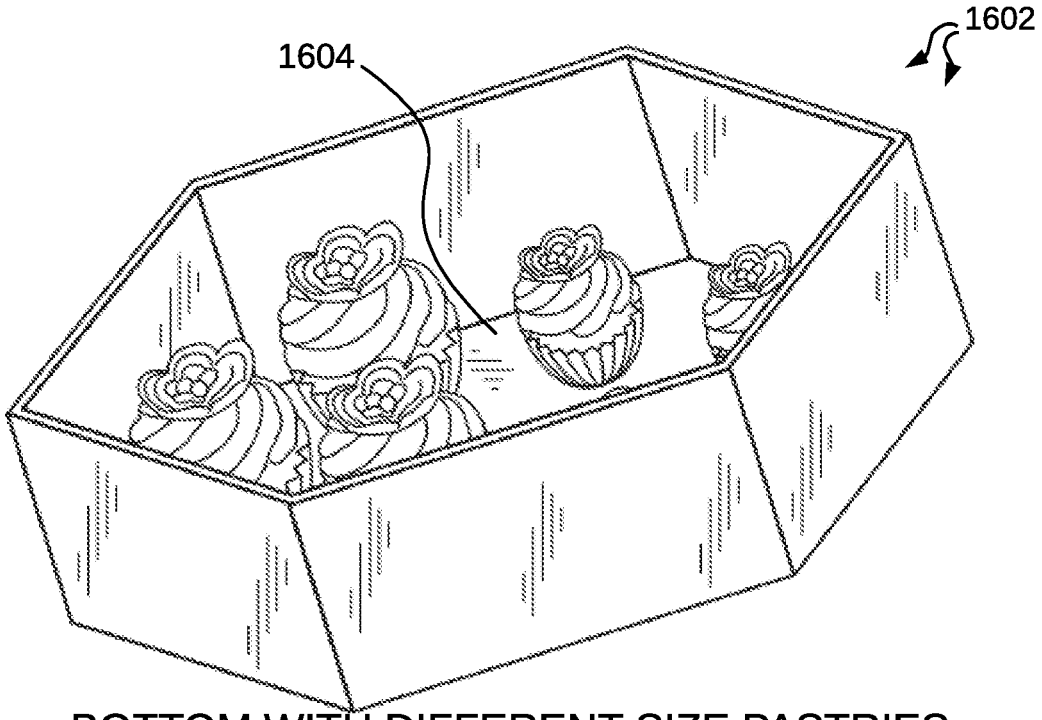
FIG. 23 shows a perspective view of a bottom of the configurable pastry container shown in FIG. 16 that is configured to hold six pastries having different sizes.

FIG. 23 shows a perspective view of the bottom 1602 of the configurable pastry container 1600 shown in FIG. 16. As illustrated in FIG. 23, the configurable openings of the rack 1604 are configured to hold six pastries having different sizes.

Figure 24:
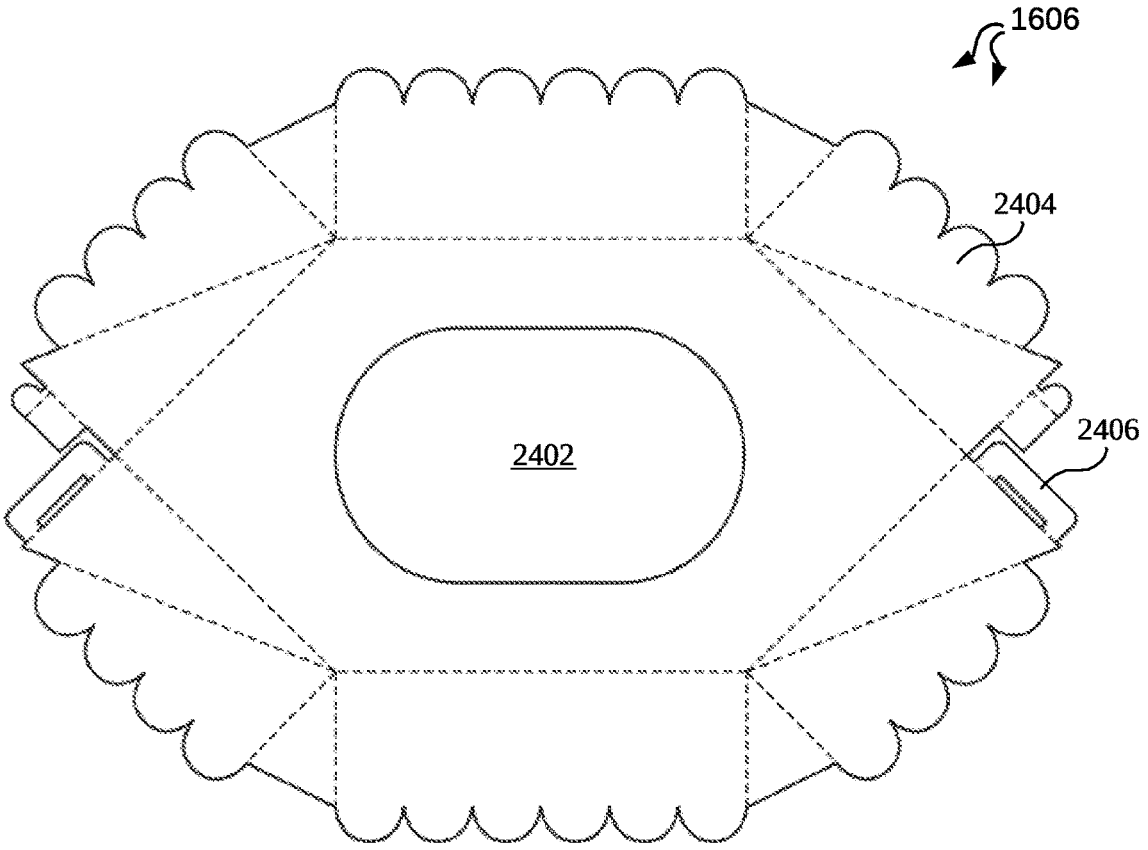
FIG. 24 shows an exemplary unfolded form of the top portion shown in FIG. 16.

FIG. 24 shows an exemplary unfolded form of the top 1606 of the configurable pastry container 1600 shown in FIG. 16. The top 1606 comprises a transparent window 2402, foldable tabs, such as tab 2404, and locking tabs, such as tab 2406.

Figure 25:
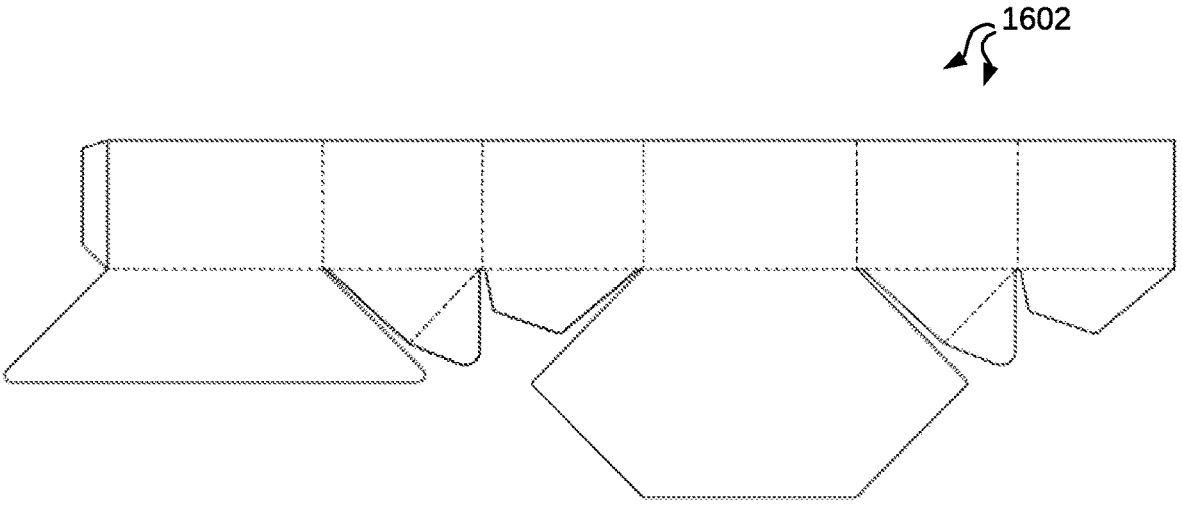
FIG. 25 shows an exemplary unfolded form of the bottom portion shown in FIG. 16.

FIG. 25 shows an exemplary unfolded form of the bottom 1602 of the configurable pastry container 1600 shown in FIG. 16. In an embodiment, the bottom 1602 is formed by folding along the dotted lines shown in FIG. 25.

Figure 26:
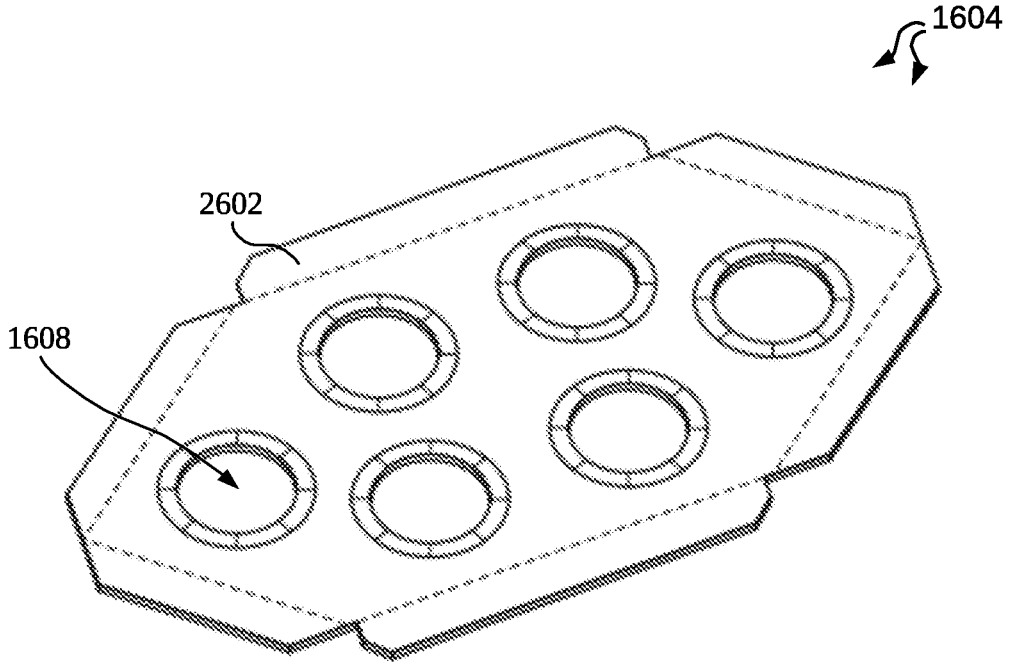
FIG. 26 shows a perspective view of an adjustable rack shown in FIG. 16 that is configured to secure a half dozen pastries.

FIG. 26 shows a perspective view of the adjustable rack 1604 shown in FIG. 16 that is configurable to secure a half dozen pastries. For example, the rack 1604 includes configurable openings (e.g., 1608) that can be configured as described with reference to FIG. 13 to secure different sized pastries.

Figure 27:
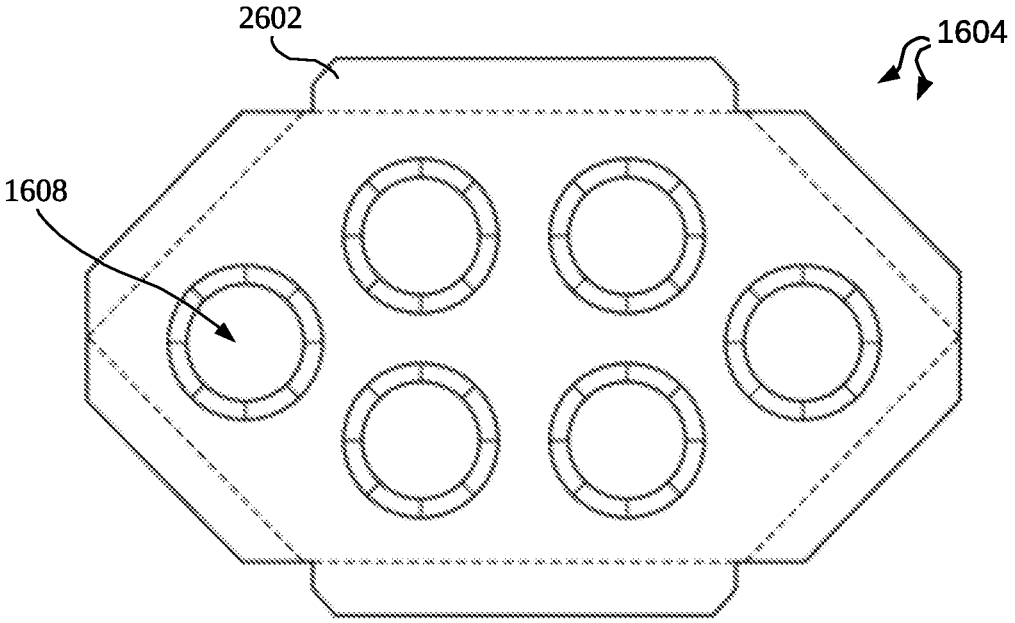
FIG. 27 shows a top view of the adjustable rack shown in FIG. 26.

FIG. 27 shows a top view of the adjustable rack 1604 shown in FIG. 26.

Figure 28:
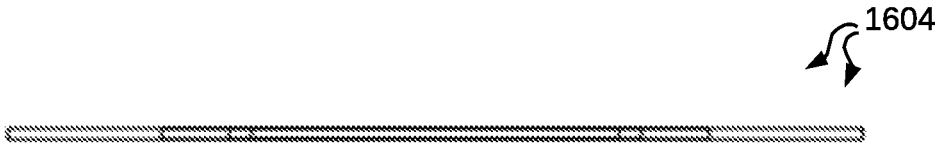
FIG. 28 shows exemplary side and end edge views of the adjustable rack shown in FIG. 27.
Figure 28:
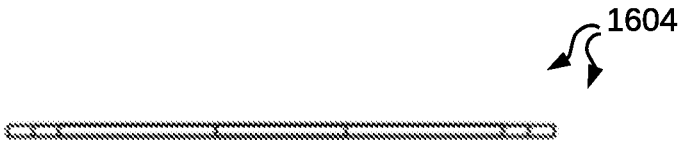

FIG. 28 shows exemplary side and end edge views of the adjustable rack shown in FIG. 27.

Figure 29:
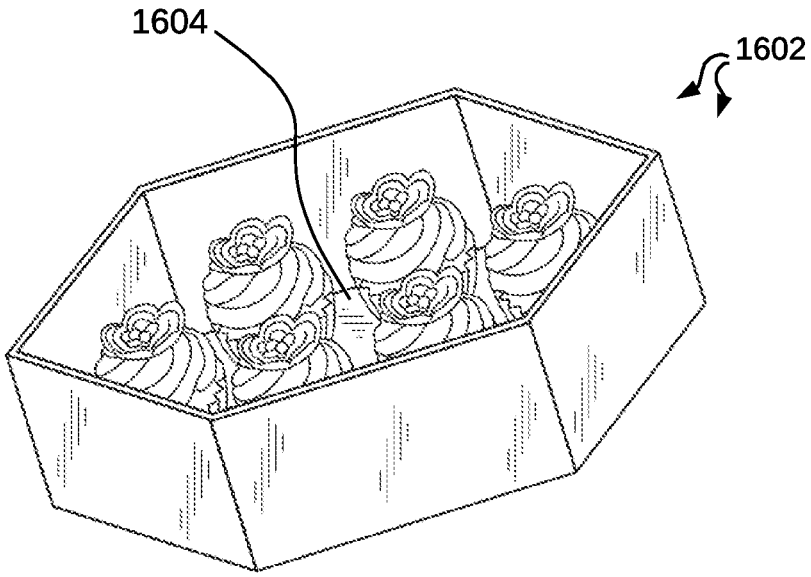
FIG. 29 shows a perspective view of a bottom of the configurable pastry container shown in FIG. 16 that is configured to hold six same-size pastries.

FIG. 29 shows a perspective view of the bottom 1602 of the configurable pastry container 1600 shown in FIG. 16. As illustrated in FIG. 29, the configurable rack 1604 is configured to hold six same-size pastries.

Although certain specific embodiments are described above in order to illustrate the invention, the invention is not limited to the specific embodiments. The configurable rack is formed to form any desired number of pastries. In various embodiments, the configurable rack is formed to secure a selectable number of pastries selected from the group consisting of: one pastry, two pastries, three pastries, four pastries, five pastries, six pastries, seven pastries, eight pastries, nine pastries, ten pastries, eleven pastries, twelve pastries, thirteen pastries, fourteen pastries, fifteen pastries, sixteen pastries, seventeen pastries, eighteen pastries, nineteen pastries, twenty pastries, twenty-one pastries, twenty-two pastries, twenty-three pastries, twenty-four pastries, twenty-five pastries, twenty-six pastries, twenty-seven pastries, twenty-eight pastries, twenty-nine pastries, thirty pastries, thirty-one pastries, thirty-two pastries, thirty-three pastries, thirty-four pastries, thirty-five pastries, thirty-six pastries, thirty-seven pastries, thirty-eight pastries, thirty-nine pastries, forty pastries, forty-one pastries, forty-two pastries, forty-three pastries, forty-four pastries, forty-five pastries, forty-six pastries, forty-seven pastries, and forty-eight pastries. Accordingly, various modifications, adaptations, and combinations of various features of the described embodiments can be practiced without departing from the scope of the invention as set forth in the claims.

What is claimed is:

1. A container, comprising:

a container bottom, wherein the container bottom includes a bottom surface and a plurality of side surfaces;

a configurable rack that is placed within the container bottom, wherein the configurable rack is separate and removable from the container bottom, wherein the configurable rack comprises one or more configurable openings that are configured to secure pastries having a plurality of sizes, wherein each of the configurable openings comprises at least one removable tab that can be removed to configure the size of that opening, and wherein the at least one removable tab is connected to the configurable rack such that the at least one removable tab is to be removed completely; and a container top that covers the container bottom to form an enclosed container that secures the pastries, wherein when forming the enclosed container, a portion of the container top slides along a portion of the container bottom.

2. The container of claim 1, further comprising a container tray that is placed between the bottom surface of the container bottom and the configurable rack.

3. The container of claim 1, wherein the container top includes a transparent window.

4. The container of claim 1, wherein the configurable rack is configured to secure one of a dozen pastries and a half dozen pastries.

5. The container of claim 1, wherein the bottom, rack, and top comprise at least one of paper, cardboard, and plastic.

6. The container of claim 1, wherein the bottom, rack, and top are formed by folding corresponding forms at selected fold lines.

7. The container of claim 1, wherein the one or more configurable openings form a majority of a surface of the configurable rack.

8. A method for forming a configurable container, the method comprising:

forming a container bottom;

forming a configurable rack having configurable openings that are sized to secure a plurality of pastries, wherein the configurable rack is separate and removable from the container bottom, wherein each of the configurable openings comprises at least one removable tab that can be removed to configure the size of that opening, and wherein the at least one removable tab is connected to the configurable rack such that the at least one removable tab is to be removed completely;

forming a container top;

placing the configurable rack within the container bottom; and placing the container top over the container bottom.

9. The method of claim 8, further comprising:

forming a container tray; and placing the container tray between the container bottom and the configurable rack.

10. The method of claim 8, further configuring the configurable openings to secure at least one of a plurality of pastry sizes.

11. The method of claim 8, wherein the operation of forming the container top comprises forming the container top to include a transparent window.

12. The method of claim 8, wherein the operation of forming the configurable rack to secure one of a dozen pastries and a half dozen pastries.

13. The method of claim 8, further comprising forming the container top, configurable rack, and the container bottom from at least one of paper, cardboard, and plastic.

14. The method of claim 8, further comprising forming the container top, configurable rack, and the container bottom by folding corresponding forms at selected fold lines.

15. The method of claim 8, wherein the configurable rack has an upper surface with a surface area, and wherein most of the surface area of the upper surface is consumed by the configurable openings.

* * * * *